US005401109A

United States Patent [19]

Tatsumi et al.

[11] Patent Number: 5,401,109

[45] Date of Patent: Mar. 28, 1995

[54] SHUTTLE TYPE LINE PRINTER

[75] Inventors: Juichi Tatsumi, Iruma; Manabu Muto, Kitakyushu; Kenji Mori; Hajime Hayase, both of Iruma, all of Japan

[73] Assignees: Kabushiki Kaisha Yasakawa Denki, Fukuoka; Ye Data, Inc., Saitama, both of Japan

[21] Appl. No.: 201,025

[22] Filed: Feb. 24, 1994

[30] Foreign Application Priority Data

Mar. 10, 1993 [JP] Japan ..... 5-087725
Oct. 29, 1993 [JP] Japan ..... 5-304520

[51] Int. Cl.[6] ..... B41J 25/304

[52] U.S. Cl. ..... 400/322; 400/320; 400/341; 101/93.08

[58] Field of Search ..... 101/93.08, 93.09; 400/320, 222, 341

[56] References Cited

U.S. PATENT DOCUMENTS 4,749,294 6/1988 Barrus et al. ..... 400/322
4,854,756 8/1989 McCrimmon, Jr. et al. ..... 400/322
4,889,438 12/1989 Forsyth et al. ..... 400/322
4,921,365 5/1990 Sanders, Jr. et al. ..... 400/322

*Primary Examiner*—Edgar S. Burr
*Assistant Examiner*—John S. Hilten
*Attorney, Agent, or Firm*—Wenderoth Lind & Ponack

[57] ABSTRACT

A mounting bed integral with a hammer bank is disposed parallel to a counter balancer composed of a counter balancer constituting member and a yoke. The mounting bed and the yoke are provided with solenoid coils opposed to a permanent magnet provided on the frame, and a pair of bearings are arranged between the mounting bed and the counter balancer constituting member. A position sensor for the mounting bed and the counter balancer is provided. A controller is provided to control a current and direction of the solenoid coil by a detection signal from the position sensor. The mounting bed integral with the hammer bank and the counter balancer are shuttle-operated in opposite directions by the controller.

3 Claims, 11 Drawing Sheets

SHUTTLE TYPE LINE PRINTER

BACKGROUND OF THE INVENTION AND PRIOR ART

The present invention relates to a shuttle type line printer in which a hammer bank unit having a plurality of printing hammers mounted widthwise of paper and a counter balancer unit are separately reciprocated in opposite directions to perform printing.

A conventional shuttle type line printer in constructed as shown in Japanese Laid-Open Patent No. 288657/1991 and FIG. 1. The conventional shuttle type line printer shown in FIG. 1 will be first described for better understanding, and the construction thereof is as follows.

In FIG. 1, reference numeral 1 designates a hammer bank provided with a plurality of printing hammers along printing lines 1' designates a hammer bank mounting bed; element 2 is a yoke and counter balancer provided with solenoid coils 3-1 and 3-2. This counter balancer 2 is provided parallel with the hammer bank mounting bed 1' and is connected to a connection belt 5 extended over rotary drums 4-1 and 4-2 provided on the opposite sides so that they are oscillated in opposite directions.

The solenoid coils 3-1 and 3-2 stand face to face with permanent magnets 6-1 and 6-2 secured to a frame (not shown) to constitute a linear motor, and a current is allowed to flow into the solenoid coils in the reverse direction at fixed intervals so that the counter balancer 2 and the hammer bank 1 are oscillated in opposite directions.

Reference numerals 7-1 to 7-4 respectively designate repulsion stoppers provided on opposite sides in order to minimize a motor thrust required for deceleration at the end of the oscillation strokes of the hammer bank 1 and the counter balancer 2. Reference numeral 8 designates a platen. It is to be noted that the repulsion stoppers in FIG. 1 are schematically shown, and are actually formed from rubber or a spring system such as a spring.

In the conventional hammer bank oscillation apparatus shown in FIG. 1, both the hammer bank mounting bed 1' and the counter balancer 2 simultaneously collide with repulsion springs opposite to left and right from each other at the end of the shuttle operation. However, since they are connected by the connection belt 5, a force couple $F \times 2L$, which is expressed by the product between a force F caused by the collision and a distance 2 L between axes of the hammer bank mounting bed 1' and the counter balancer 2, occurs to produce an impact force by which the hammer bank mounting bed 1' is rotated, resulting in the cause of vibrations which brings forth the lowering of the printing dot accuracy. Further, since the connection belt 5 is used to connect the hammer bank mounting bed 1' and the counter balancer 2, the part accuracy and the assembly accuracy required to secure the reliability of the connection belt 5 are very high, adversely affecting the cost. In addition, the low strength of the connection belt 5 impedes the realization of higher speed.

On the other hand, for the purpose of attaining a high-speed printing of a printer, there is a system in which printing hammers mounted on the hammer bank are provided in a multi-stage fashion in a direction of feeding paper to be printed as shown in FIG. 2. In the case where this system is used, the reciprocating amount of a shuttle mechanism (a mechanism for reciprocating a hammer bank unit and a counter balancer unit) in a direction widthwise of the paper increases. Morover, it is preferred that an area for printing to be effected is uniform in order to improve the quality of printing.

In the construction shown in FIG. 1, however, the hammer bank unit and the counter balance unit are connected by the connection belt. Therefore, it has been difficult to increase the reciprocation amount of the hammer bank in the direction widthwise of the paper and to make the printing area uniform.

SUMMARY OF THE INVENTION

An object of the present invention is to provide a shuttle type line printer having a hammer bank oscillation apparatus of a new system mounted thereon which, without using a connection belt, enables higher reliability and higher speed than prior art systems, and enables the realization of a reduction in parts and assembly costs, and enables an increase in the reciprocating amount of the hammer bank and enables a uniform printing area rate.

For achieving the aforementioned object according to the present invention, a hammer bank and a counter balancer are laterally movably juxtaposed without using a conventional connection belt; a solenoid drive device for reciprocating the hammer bank and counter balancer in opposite directions is provided; repulsion stoppers for repulsing the hammer bank and counter balancer at the end of an oscillation stroke are provided, and position sensors for the hammer bank and the counter balancer are provided, the aforesaid solenoid drive device being controlled by the position sensor.

The present invention minimizes the vibration produced when the hammer bank or the counter balancer collides with the repulsion stopper (repulsion rubber or repulsion spring) used in the present invention. On the hammer side and on the balancer side of a shuttle mechanism of a printer are provided means for measuring and detecting an arrival at a turning portion, a means for measuring and detecting every dot position, a means for knowing a direction by changing a signal of a dot position by 90 degrees, and a means for laterally moving, by a microcomputer, the positions of repulsion stoppers for turning by means for measuring turned time so that the positions of the repulsion stoppers are automatically adjusted whereby the travel time on the hammer side of the shuttle mechanism is coincident with that of the balancer side, the turning time necessary for feeding paper is adjusted, a point at which the direction changes is accurately found and a point at which the direction changes on the hammer side of the shuttle mechanism is coincident with that of the balancer side, thus providing the better operation of the shuttle mechanism and lowering the vibrations.

In the shuttle type line printer according to the present invention, the hammer bank and the counter balancer are driven in opposite directions by the solenoid drive device so that they can perform the shuttle operation independently. Therefore, the lateral vibration is suppressed similarly to the conventional shuttle type line printer, and since the connection belt as in the prior art is not used, no problems exist due to the connection belt. Furthermore, even at the higher speed, a printing quality of a high accuracy can be obtained by the position detector.

According to the present invention, since the time required for movement on the hammer side can be made uniform with that on the balancer side, the better operation of the shuttle mechanism and the lowering of the vibration can be attained.

DETAILED DESCRIPTION OF THE PREFERRED EMBODIMENTS

Figure 1:
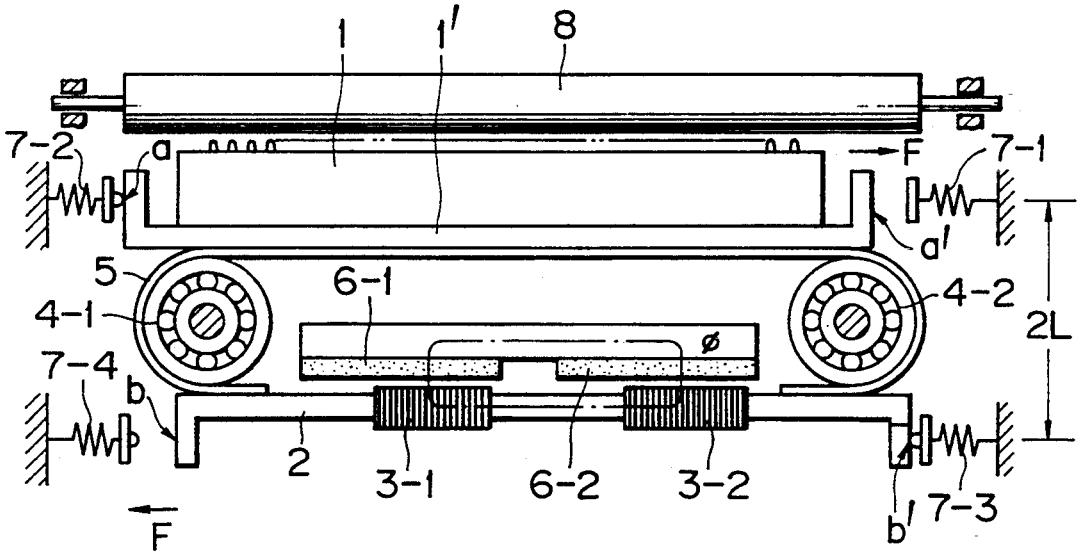
FIG. 1 PRIOR ART
FIG. 1 is a view showing the construction of essential parts of a conventional apparatus as viewed from the bottom.
Figure 2:
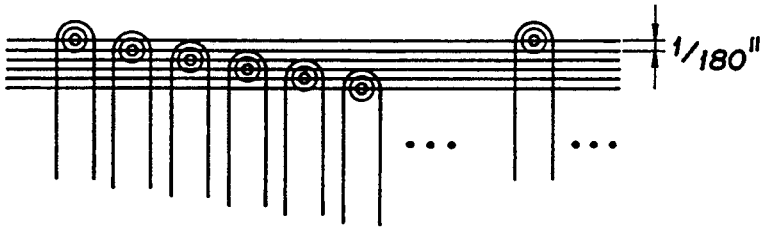
FIG. 2 PRIOR ART
FIG. 2 is a view showing the arrangement of a well known multi-stage hammer.
Figure 3:
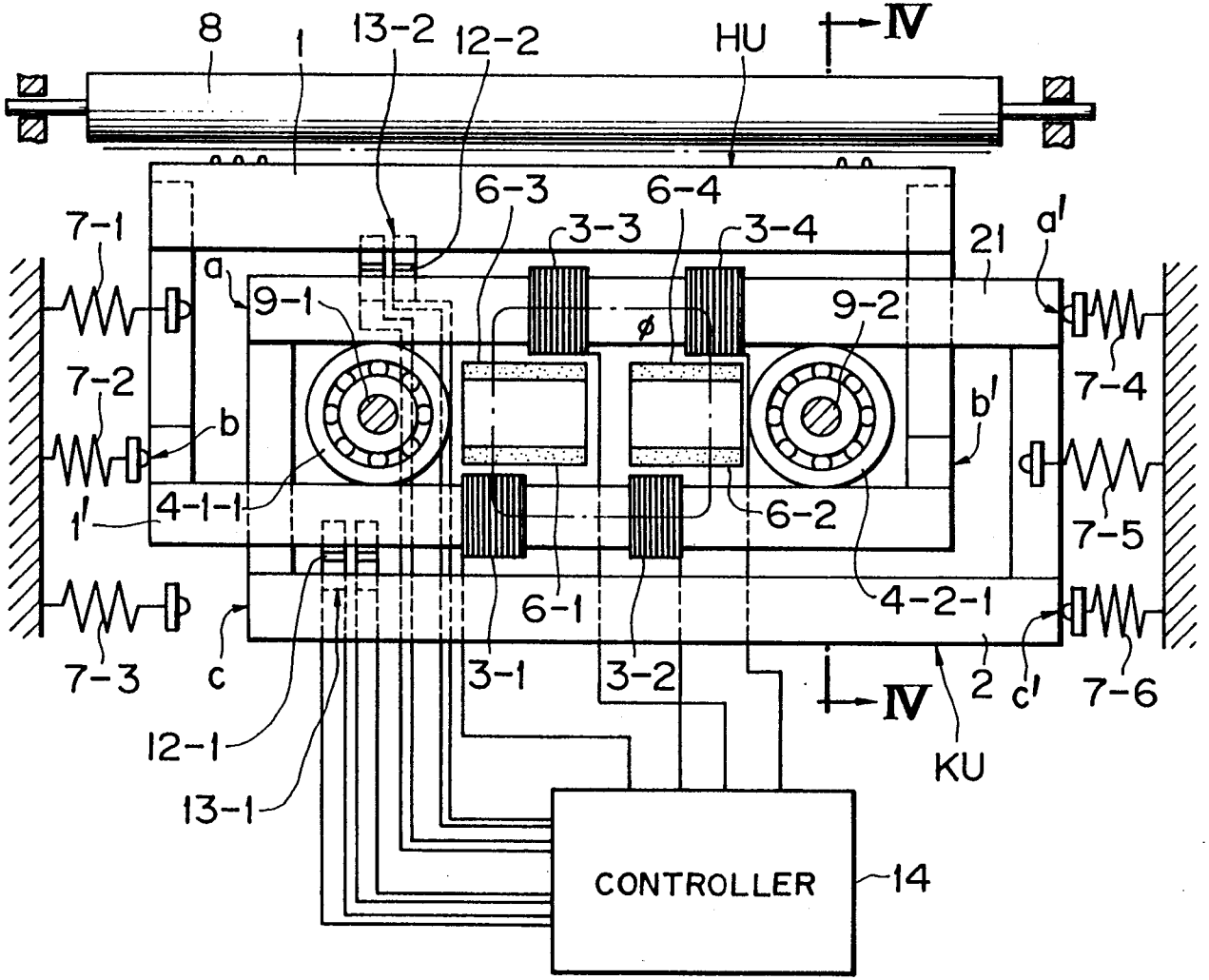
FIG. 3 is a view showing the construction of essential parts of a first embodiment according to the present invention as viewed from the bottom.
Figure 4:
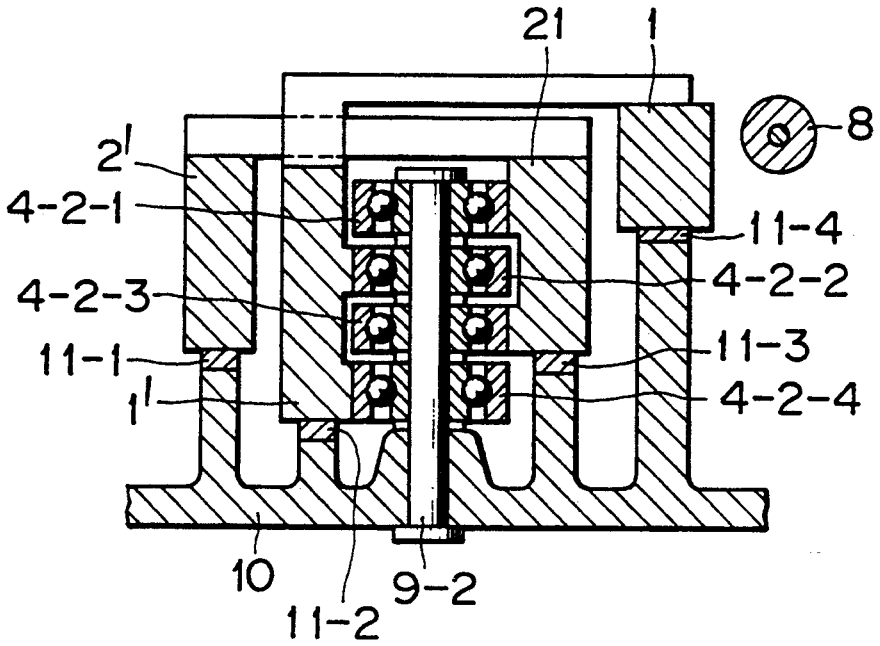
FIG. 4 is a longitudinal sectional view taken on line IV—IV.

FIGS. 3 and 4 show a first embodiment according to the present invention, FIG. 3 being a lower surface view and FIG. 4 being a longitudinal sectional view taken on line IV—IV.

In FIGS. 3 and 4, reference numeral 1 designates a hammer bank provided with a plurality of printing hammers along the printing lines. The hammer bank 1 is mounted on a U-shaped hammer bank mounting bed 1' to constitute a rectangular frame-like hammer bank unit HU. A counter balancer 2 is connected to a yoke 21, which also constitutes a rectangular frame-like counter balancer unit KU.

Elements 9-1 and 9-2 are shafts mounted on a base 10 as shown in FIG. 4. Each shaft has four bearings 4-1-1 to 4-1-4 and 4-2-1 to 4-2-4, respectively, mounted thereon. The bearings 4-1-2, 4-1-4, and 4-2-2, 4-2-4 are placed in contact with the hammer bank mounting bed 1', and the bearings 4-1-1, 4-1-3 and 4-2-1, 4-2-3 are placed in contact with the yoke 21.

Solenoid coils 3-1 and 3-2 and solenoid coils 3-3 and 3-4 are mounted on the hammer bank mounting bed 1' and the yoke 21, respectively. The solenoid coils 3-1 and 3-3 are opposed to permanent magnets 6-1 and 6-3, respectively, the permanent magnets being fixed to one and the same yoke mounted on a frame (not shown), whereas the solenoid coils 3-2 and 3-4 stand face to face with permanent magnets 6-2 and 6-4, respectively, the permanent magnets being fixed to one and the same yoke mounted on a frame to constitute a linear motor.

Reference numerals 7-1 to 7-6 designate repulsion stoppers. The repulsion stoppers 7-2 and 7-5 stand face to face with both sides of the hammer bank mounting bed 1' whereas the repulsion stoppers 7-1, 7-3 and 7-4, 7-6 stand face to face with both sides of the counter balancer 2.

Reference numeral 8 designates a platen; 11-1 to 11-4 designate bearings; and 12-1 and 12-2 designate linear sliders mounted on the hammer bank mounting bed 1' and the yoke 21 to constitute a position sensor together with photosensors 13-1 and 13-2 secured to the frame.

A controller 14 controls currents of the solenoid coils 3-1, 3-2 and 3-3, 3-4 in accordance with a position signal of the position sensor so as to control the speed and the range of lateral movement of the hammer bank 1 and the counter balancer 2.

It is to be noted that the linear slider 12-1 and the linear slider 12-2 may be mounted on the counter balancer constituting member 2' and the hammer bank 1, respectively.

According to the shuttle type line printer according to the present invention shown in FIGS. 3 and 4, in operation, the hammer bank mounting bed 1' is urged against the bearings 4-1-2, 4-1-4 and 4-2-2, 4-2-4 mounted on the shafts 9-1 and 9-2 by the magnetic attraction forces of the permanent magnets 6-1 and 6-2 whereas the counter balancer 2 is likewise urged against the remaining two of the bearings 4-1-1, 4-1-3 and 4-2-1, 4-2-3, and the gravity direction thereof is borne by the bearings 11-1 to 11-4.

Accordingly, when the hammer bank 1 and the counter balancer are driven by the controller 14, the oscillation thereof is independently controlled in opposite directions. First, the hammer bank 1 and the mounting bed 1' thereof collide at the left end with the repulsion stopper 7-2 while the counter balancer collides with the repulsion stoppers 7-4 and 7-6 in synchronism with the movement of the hammer bank 1 and the mounting bed 1' in the opposite direction. After the subsequent half cycle, the controller 14 causes the hammer bank 1 and the mounting bed 1' thereof and the counter balancer to simultaneously collide with the repulsion stopper 7-5 and repulsion stoppers 7-1 and 7-3, respectively.

The printing operation is carried out during the lateral movement of the hammer bank, and a sheet of paper is fed during the time when the hammer blank collides with the repulsion stopper and its direction is reversed.

The center of gravity of the hammer bank 1 and the mounting bed 1' thereof and the counter balancer constituting member 2' and the yoke 21 nearly matches the collision point b-b' of the repulsion stopper. The collision point b-b' is set so as to occupy the center of other collision points a-a' and c-c'. Accordingly, the force couple to be imparted to a printer casing is 0, enabling the suppression of vibration which deteriorates the printing accuracy.

In the case where the setting cannot be made to the position where the center of gravity of the hammer bank 1 and the mounting bed 1' thereof matches the b-b', the center of gravity of the counter balancer 2 comprising the counter balancer constituting member 2' and the yoke 21 is moved in the same direction as that described above from the center of a-a' and c-c' so as to negate the force couples at both ends, and it is designed so that point b-b' assumes a central position between a-a' and c-c' thereby enabling the achievement of the object of the present invention.

Figure 6:
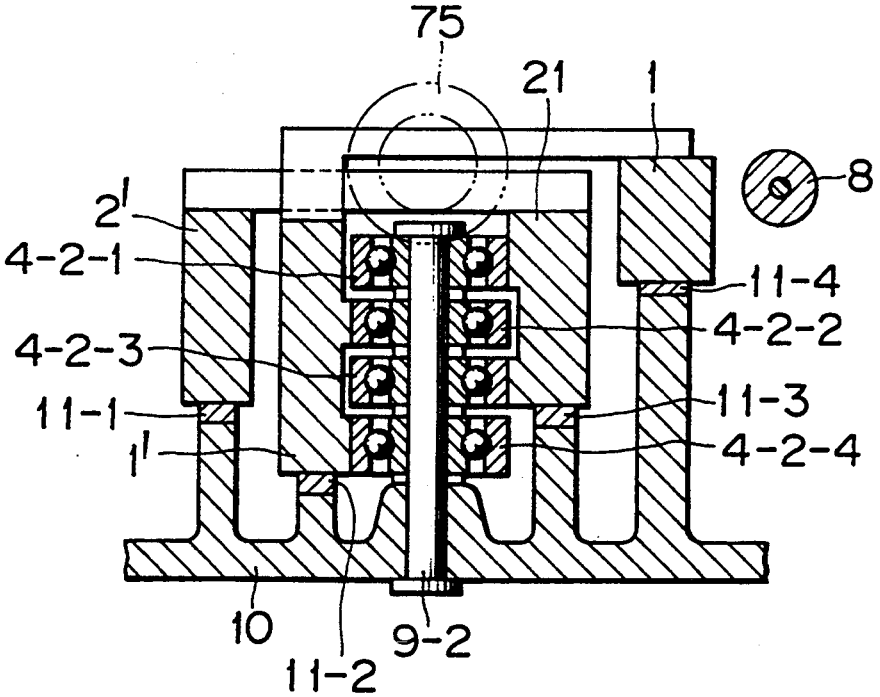
FIG. 6 is a longitudinal sectional view taken on line VI—VI.
Figure 5:
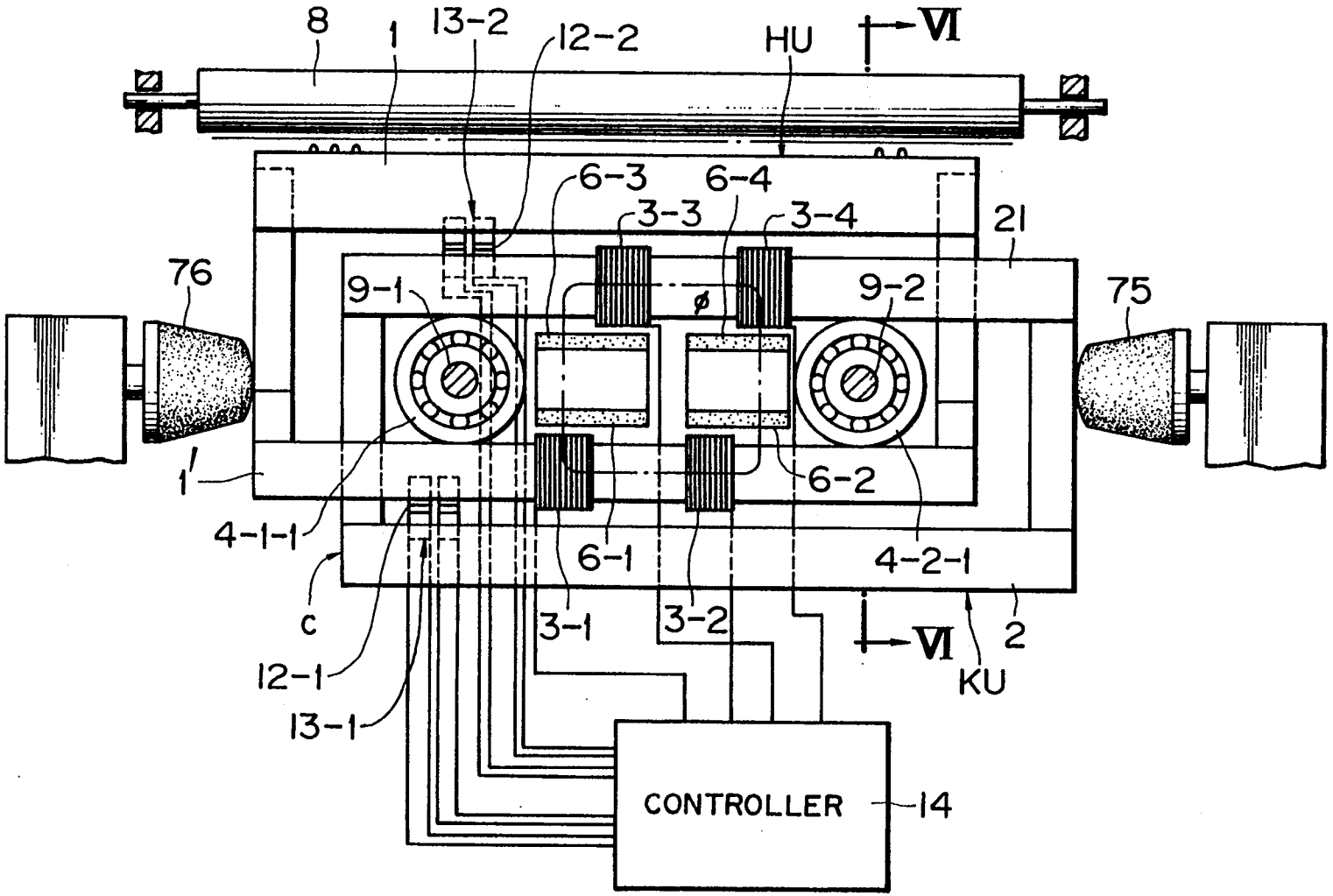
FIG. 5 is a view showing the construction of essential parts of a second embodiment according to the present invention as viewed from the bottom.
Figure 7:
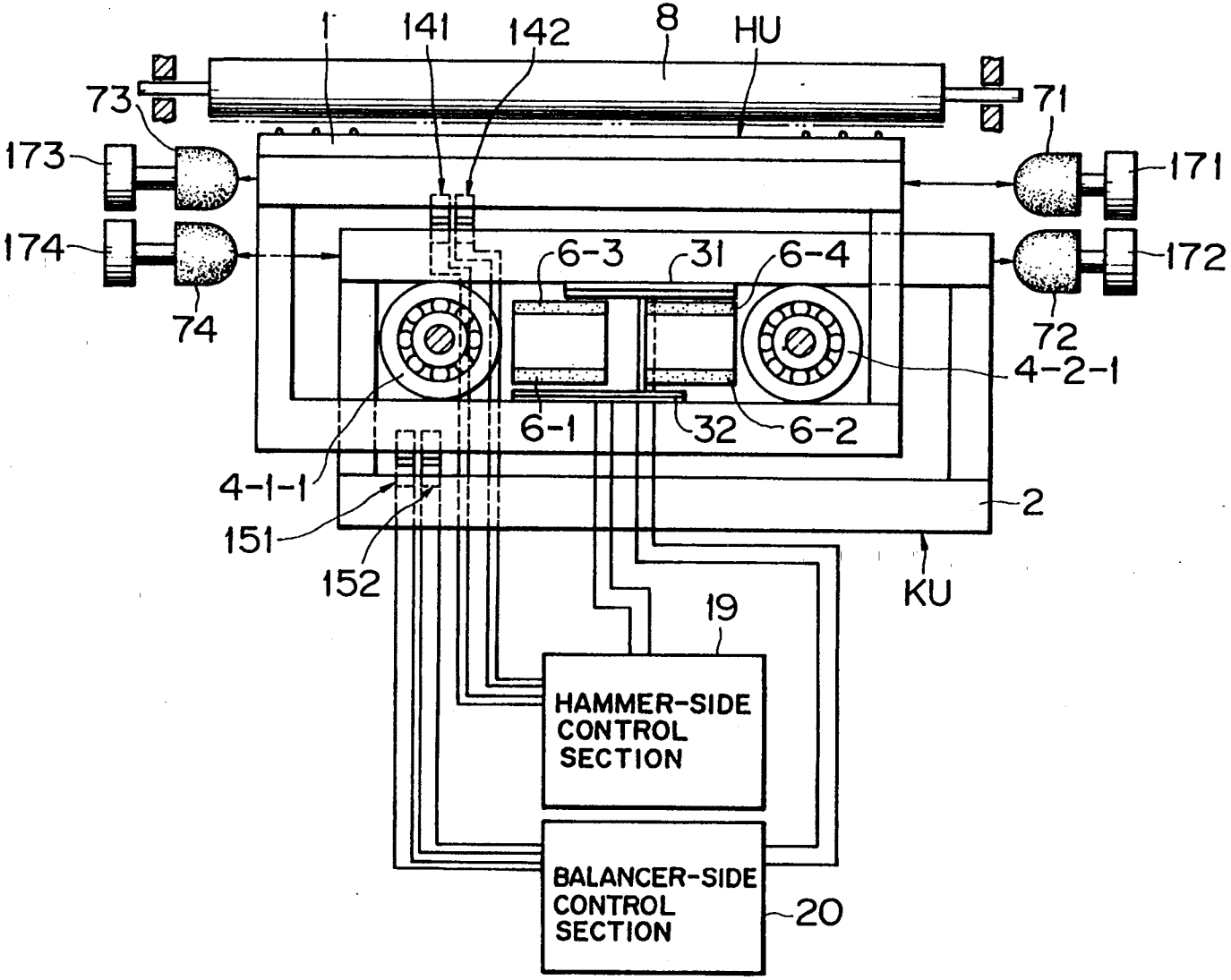
FIG. 7 is a view showing the construction of a third embodiment according to the present invention.

While in the first embodiment shown in FIGS. 3 and 4, three repulsion stoppers are provided on each of the left and right sides, it is to be noted that as in the second embodiment shown in FIGS. 5 and 6, on repulsion stopper may be provided on each of the left and right sides, or as in the third embodiment shown in FIG. 7, two repulsion stoppers may be provided on each of the left and right sides. In these embodiments, repulsion stoppers 75 and 76 with a repulsion rubber were used as the repulsion stoppers.

Incidentally, in the second and third embodiments shown in FIGS. 5 and 7, vibrations are generated and the printing quality becomes deteriorated unless the hammer bank 1 and the counter balancer 2 simultaneously impinge upon the left and right repulsion stoppers with high accuracy.

It is necessary to have the hammer side and the balancer side impinge upon the repulsion stoppers at the same time in order to reduce the vibration. However, when the hammer side and the balancer side take the same operation, the amount of movement of the hammer side must coincide with that of the balancer side in order that they impinge on the repulsion stoppers at the same time. In other words, it is necessary to adjust the positions of the repulsion rubbers in order for the amount of movement of the hammer side with that of the balancer side to coincide.

For example, in the third embodiment shown in FIG. 7, if an attempt is made to cause the amount of movement to coincide when units HU and KU impinge upon repulsion rubbers 71, 72, 73 and 74 and are pushed in, it is difficult to adjust the position of the repulsion rubber by manual operation, requiring much time for adjustment.

Further, a printer first developed has no means for measuring the time at the turning, and tries to make the coincidence with the length of boundary time. There was no way of assuring that the turning was being made at the same time.

The printer performs the paper feeding during the time when the hammer side and the balancer side impinge upon the repulsion rubbers of the repulsion stoppers, namely, until the hammer unit HU is turned, upon completion of printing, and again moves to the printing area. The printer has to secure a given time in order to accomplish a predetermined paper-feeding. It is necessary to adjust the position of the repulsion rubber of the repulsion stopper in order to secure the given time. The repulsion rubber of the repulsion stopper changes in the repulsion coefficient and the rebound amount in dependency of the environmental condition and the speed of the hammer unit HU. It is therefore necessary to adjust the position of the repulsion rubber of the stopper.

However, in the case of the shuttle mechansim in the first stage of development which makes use of a repulsion stopper with a repulsion rubber, since the replusion rubbers are secured to fixed support beds 171 to 174, respectively, there was a problem in that the turning time cannot be made constant.

Figure 8:
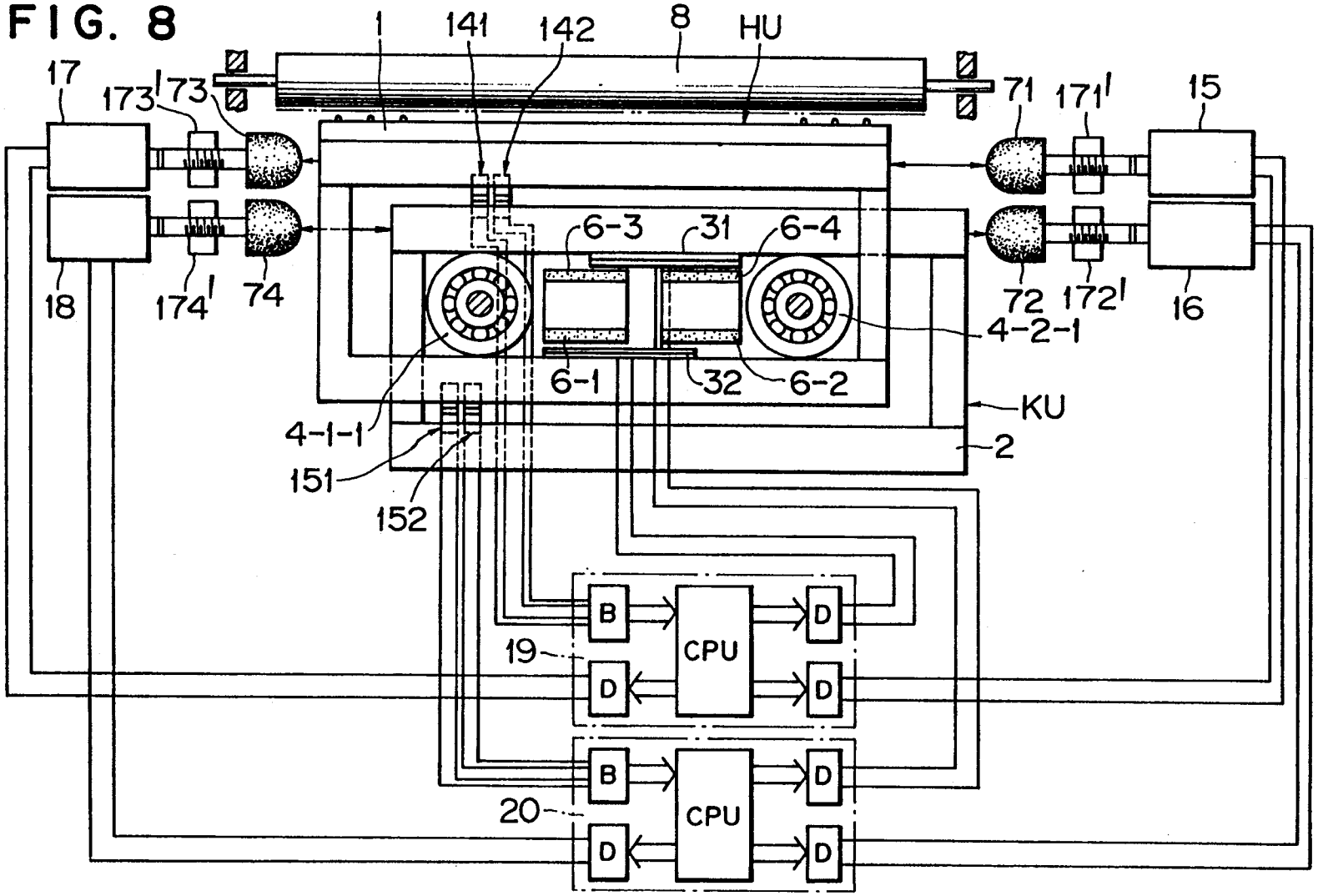
FIG. 8 is a view showing the construction of a fourth embodiment according to the present invention.

The aforesaid problem was solved by the present invention, and FIG. 8 shows a fourth embodiment thereof.

In FIG. 8, HU is a hammer bank unit (hereinafter merely referred to as a hammer side or a shuttle unit), and KU is a counter balancer unit (hereinafter merely referred to as a balancer side or a shuttle unit). On the hammer side HU and the balancer side KU are mounted repulsion stoppers 71, 72, 73 and 74 with repulsion rubbers for turning to left and right. The repulsion stoppers 71, 72, 73 and 74 are threadedly engaged with fixed support beds 171', 172', 173' and 174', respectively, and the mounting devices thereof to the fixed support beds are changed by pulse motors 15, 16, 17 and 18.

Figure 9A:
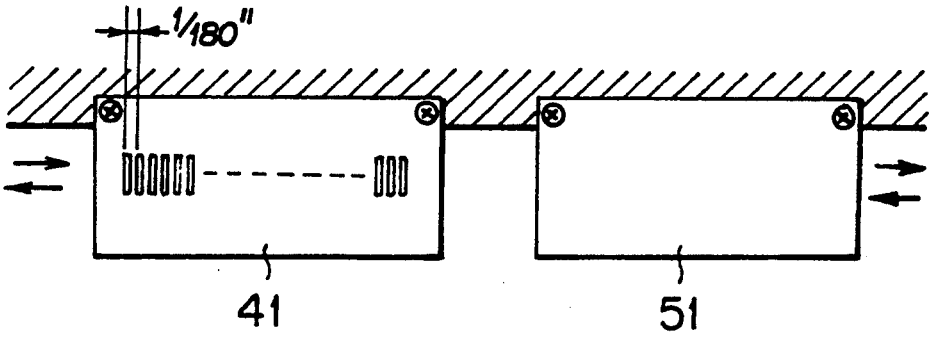
FIG. 9A is a view showing the construction of a linear slider of a linear sensor and a linear slider of a boundary sensor.
Figure 9B:
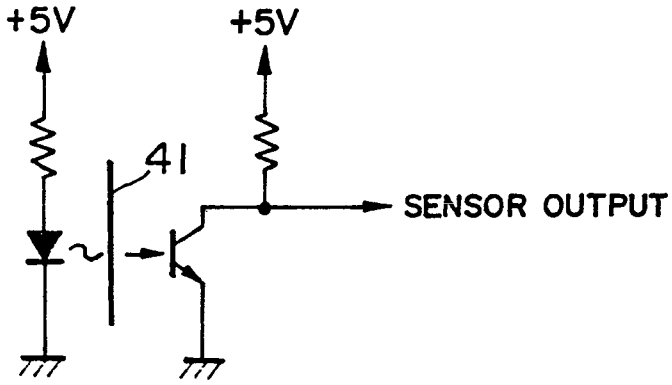
FIG. 9B is a view showing the circuit structure of a linear sensor and a boundary sensor.
Figure 9C:
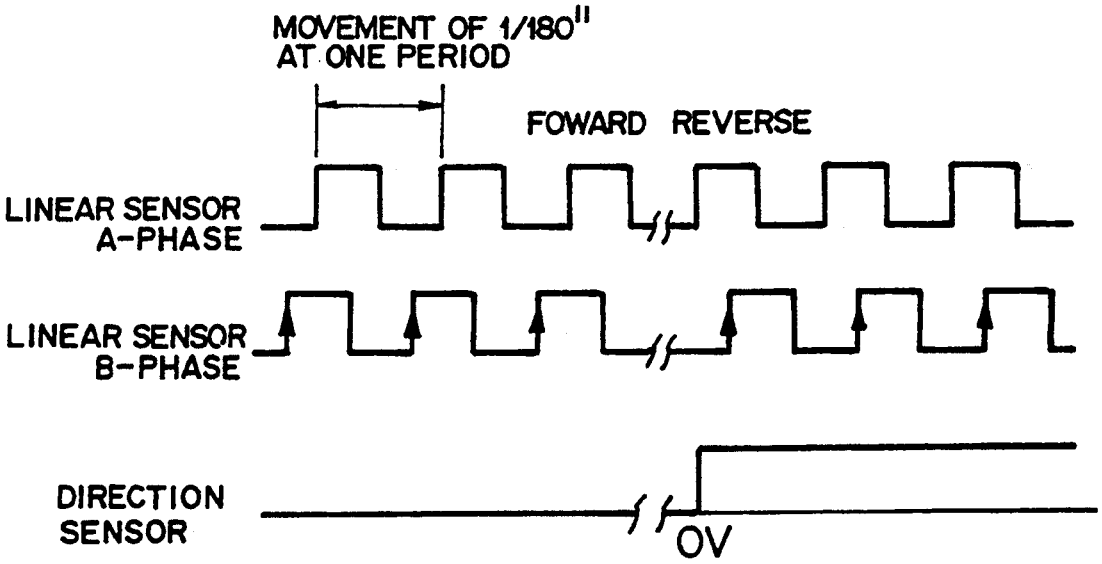
FIG. 9C is a view showing output signal waveforms of a linear sensor and a direction sensor.

As sensors, there are used linear sensors 141 and 151 comprising a linear slider 41 for outputting a pulse for one period every 1/180 inch as shown in FIG. 9A and a photo interrupter (not shown) on the hammer side HU and the balancer side KU, and boundary sensors 142 and 152 comprising a linear slider 51 and a photo interrupter (not shown), which detect the positions of the hammer bank unit HU and the counter balancer unit KU and the arrival to the boundary portion.

A slit of the boundary sensor is a slit having a predetermined length, which is mounted in the operating direction of the hammer side HU and the balancer side KU similarly to the linear sensor.

The length of the boundary time is the time till the shuttle unit passes through the sensor position and then returns.

When the shuttle mechanism starts its operation, unevennesses such as a difference in position, a difference in repulsion coefficient of repulsion rubber and the like occur in the hammer side shuttle unit HU and the balancer side shuttle unit KU.

It is here required that the time from a turning portion to a turning portion of the respective shuttle units on the hammer side and on the shuttle side is constant, and the operation should be carried out in a determined time.

Assume that the boundary time is 12 ms and the time till the detection waveform of the next boundary sensor rises is 79 ms. A printer which prints letters when the operation of the hammer side complets one reciprocation can perform the printing at a printing rate of 330 LPM in calculation. However, if the boundary time is 14 ms, the printer performs the printing at the rate of 323 LPM and as a result the printing rate lowers. Conversely, when the boundary time is less, the predetermined paper-feed operation cannot be made within such a boundary time but the entry is made into the time of the printing operation range. There occurs a phenomenon that the printing operation is once useless.

In the case of the printing thinning out printing dots as can be seen in the draft printing, the printing can be made by increasing the operating speed of the shuttle unit. However, when the operating speed of the shuttle unit is increased, the speed of impinging on the repulsion stopper increases, as a consequence of which the rebound amount of the repulsion rubber attached to the repulsion stopper changes and the boundary time also changes.

Accordingly, to make the boundary time constant can be solved by laterally operating the repulsion stoppers during the printing operation to automatically adjust them.

In the embodiment shown in FIG. 8, for the purpose of adjusting the positions of the repulsion rubbers 71, 72, 73 and 74, the repulsion rubbers are laterally moved by the pulse motors 15, 16, 17 and 18 to adjust the boundary time. Thereby, the shuttle mechanism can well secure the boundary time.

However, even if the boundary time is adjusted, vibrations occurs unless the shuttle units on the hammer side and on the balancer side of the shuttle mechanism impinge upon the repulsion rubbers and are simultaneously turned. In the embodiment of the present invention, the detection waveforms of the linear sensors were used in order to find the turned time.

Figure 10:
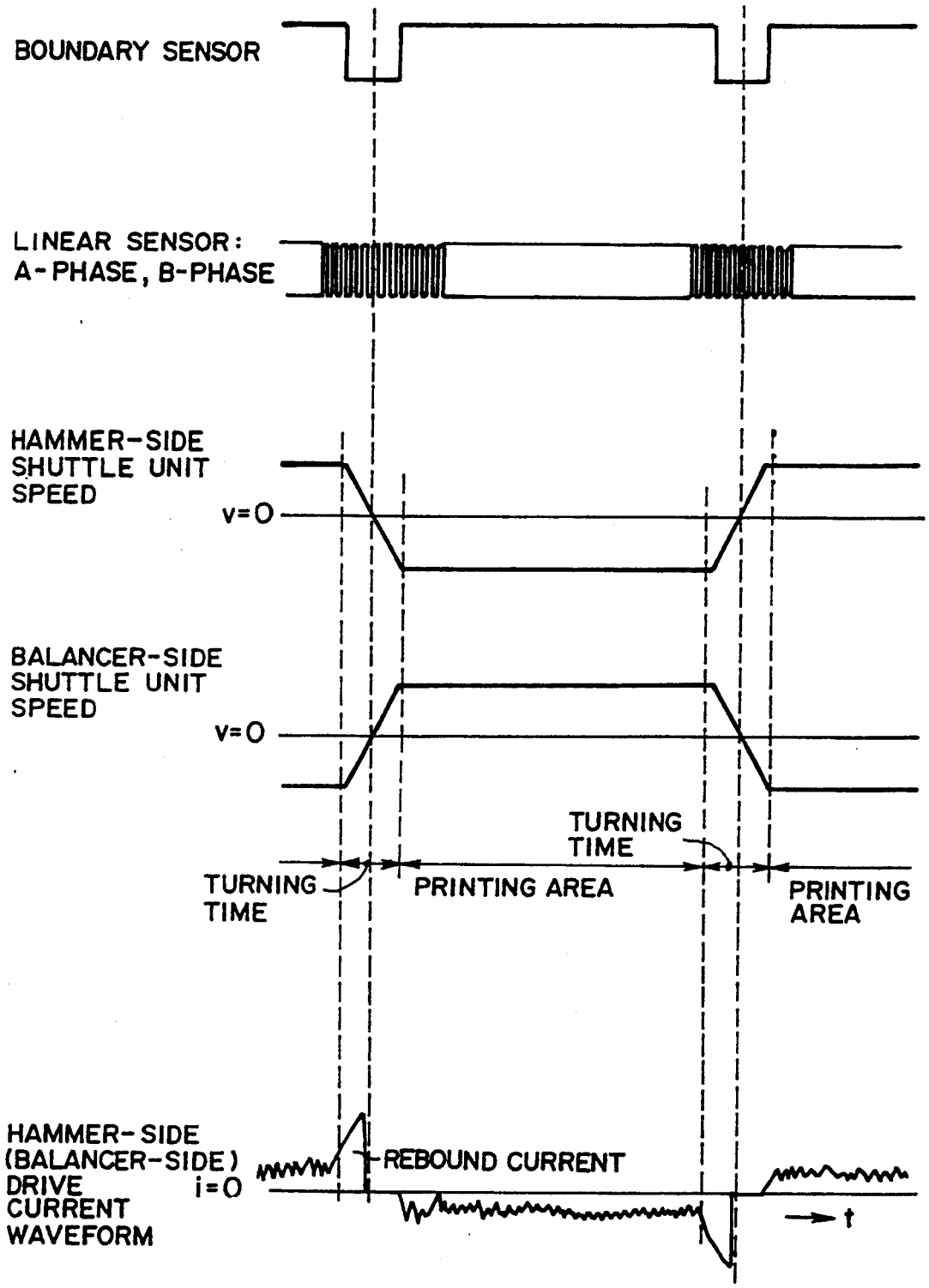
FIG. 10 is a view showing a detection signal of a sensor, the operation of a shuttle unit and the time for causing a rebound current to flow.
Figure 11:
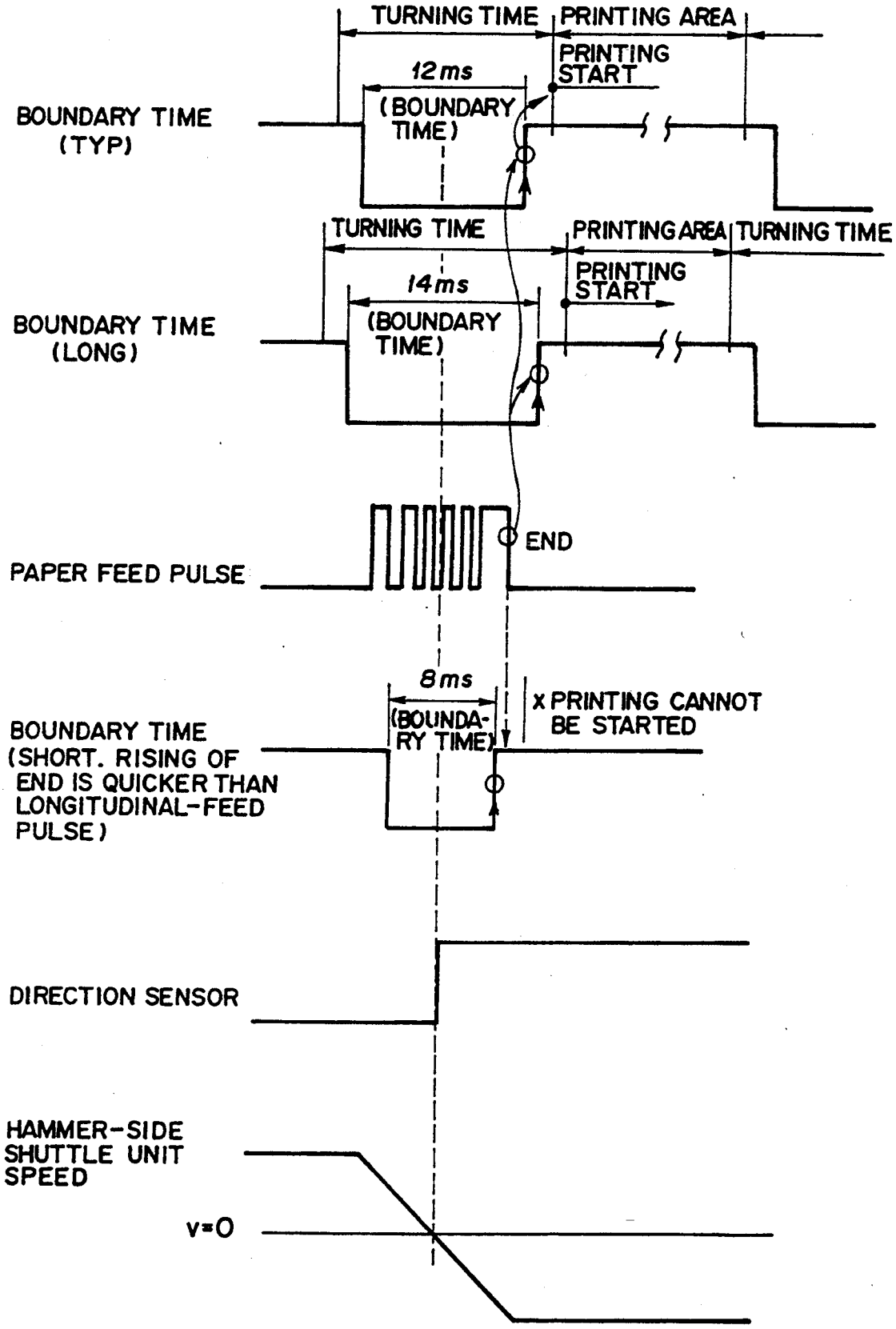
FIG. 11 is a view showing the influence affected by the magnitude of boundary time.

As shown in FIG. 9A, linear sensors each having a linear slider 41 are mounted on the hammer-side and balancer-side shuttle units. The linear sensor generates A-phase and B-phase signals as shown in FIG. 10. The A-phase and B-phase generate signals deviate by 90 degrees. The A-phase and B-phase signals are generated every 1/180 inch of the linear sensor. The printing operation is carried out in synchronism with the A-phase linear sensor signal.

Figure 12:
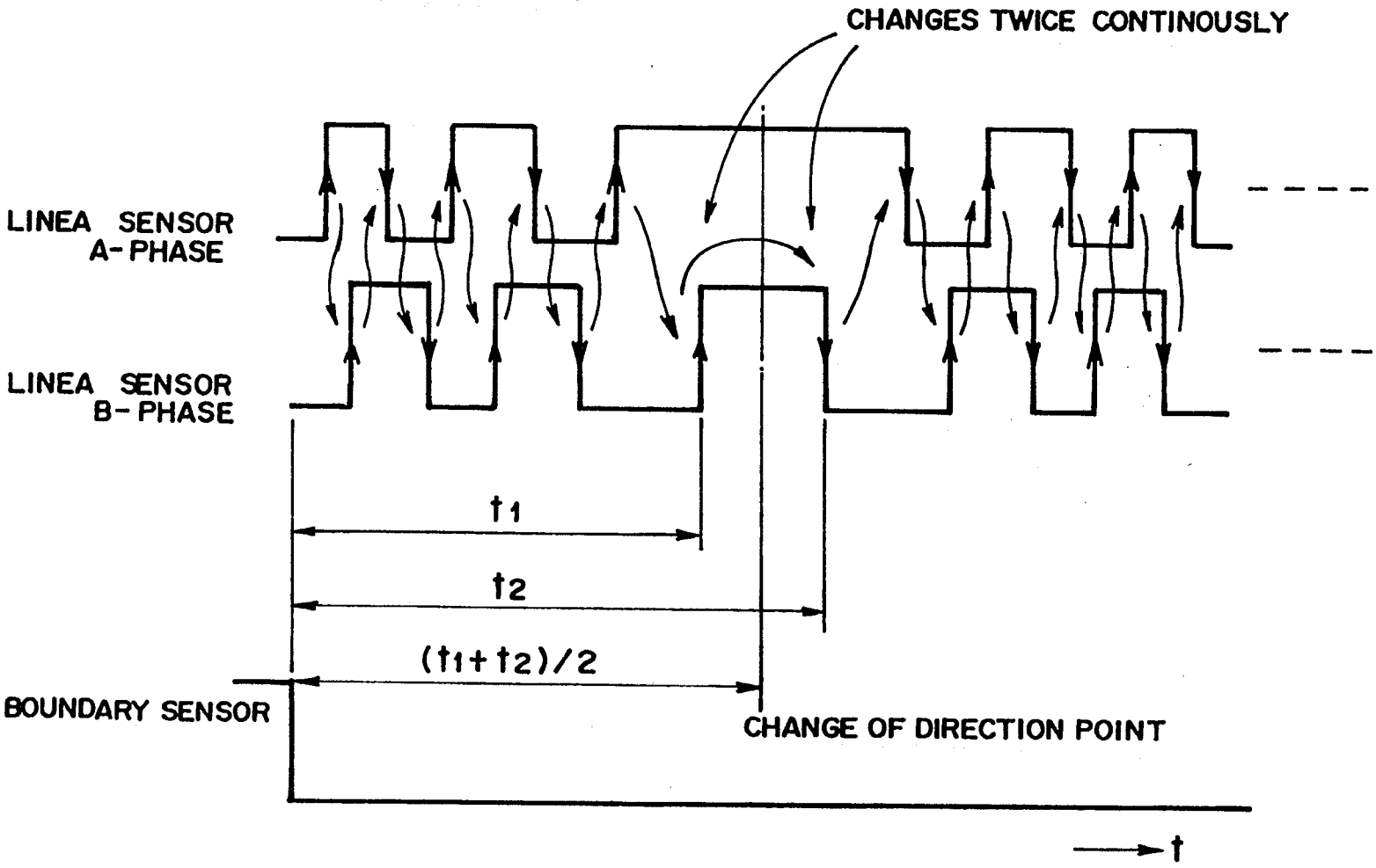
FIG. 12 is a view showing the relationship between a sensor signal and a turning time.
Figure 13:
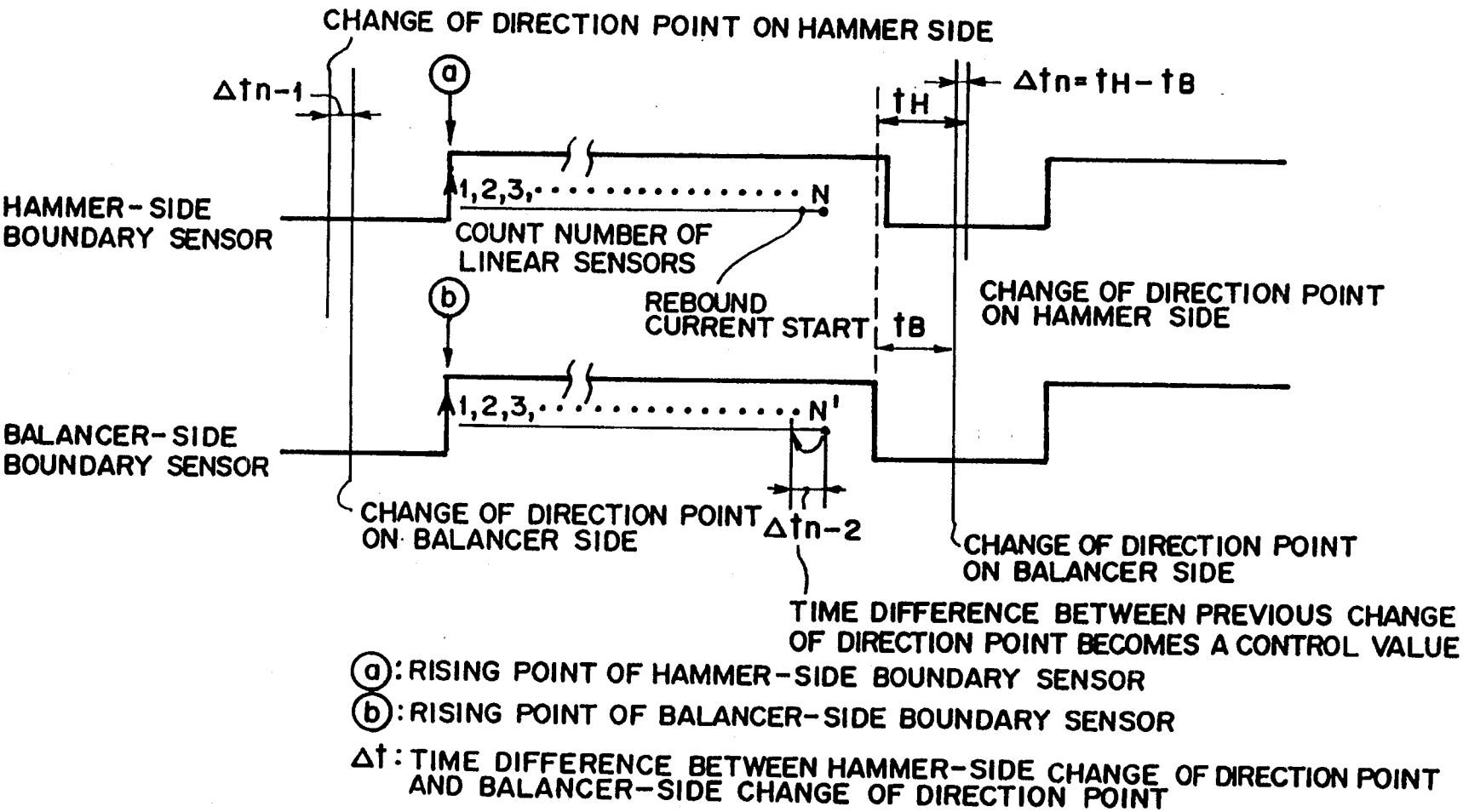
FIG. 13 shows a waveform for assisting the explanation of problem of control.

In the normal operation, changes in signals of A-phase and B-phase are alternately generated. The linear sensor signal waveforms are either A-phase or B-phase, and the changes of signals occur continuously twice. (See FIG. 12.)

This time is grasped to effect the measurement of time to make it into half, whereby the time from a certain position (for example, a point at which the boundary sensor of the shuttle unit KU on the balancer side changes) to a turning point can be measured. The time to the turning point, that is, the change of direction time $((t_1+t_2)/2)$ is otained on the hammer side and on the balancer side to obtain a time difference At between the changes of direction time.

The shuttle units on the hammer side and on the balancer side are controlled in the following manner. The number of linear sensor pulses starts to be counted from a rise of the boundary sensor, and the hammer side starts to flow a rebound current from the time when the determined number N of linear sensor pulses is detected. (See FIG. 8 for a rebound current.) The time difference $\Delta t$ between the changes of direction time is incorporated into the determined number N of linear sensor pulses to determine a start position of the rebound current.

The start position of the rebound current will be a value at the time of previous impingement in the same direction. The value of this start position is updated every measurement and controlled so that the difference $\Delta t$ between the changes of direction time assumes 0.

The hammer side in the shuttle mechanism of the printer performs the satisfactory printing operation by making the boundary time, that is, the turning time, constant and by securing the printing speed as intended, whereas the balancer side has to perform the operation while being adjusted to the hammer side. Particularly, the balancer side should adjust the change of direction time to reduce the vibration.

When the change of direction time and the difference $\Delta t$ between the changes of direction time are in the range such that they are measured but are not adjusted by the control, the pulse motors 16 and 18 on the balancer side are activated to effect the control so that the turning time is again adjusted by a software of a microcomputer, whereby a shuttle mechanism with less vibration can be prepared to provide high quality of printing.

As described above, according to the present invention, since the vibration of the printer casing itself is reduced during the printing operation, the quality of printing can be improved. Further, since the connection belt is not used, the reliability is enhanced; higher speed operation can be obtained; and the reduction in part and assembly costs can be realized.

According to the present invention, the control is effected so that the positions of the repulsion stoppers are moved to make the boundary time constant, and the turning time of the shuttle units on the hammer side and on the balancer side are measured to cause the change of direction time on the hammer side to be equal to that of the balancer side, thereby stabilizing the printing speed, reducing the vibration and providing a satisfactory quality of printing.

What is claimed is:

1. A shuttle type line printer comprising: a hammer bank provided with a plurality of printing hammers along printing lines; a counter balancer, said hammer bank and said counter balancer being laterally movably juxtaposed; separate electromagnetic driving devices for respectively reciprocating said hammer bank and said counter balancer in opposite directions; rebounding stoppers for rebounding said hammer bank and said counter balancer at respective ends of reciprocating strokes of said hammer bank and said counter balancer, and respective position sensors detecting a position for each of said hammer bank and said counter balancer, a controller having means for controlling said electromagnetic driving devices, said electromagnetic devices being separately controlled by the controlling means as a function of the position detected by said position sensors.

2. A shuttle type line printer having a hammer bank unit provided with a plurality of printing hammers, said hammer bank reciprocated along printing lines and a counter balancer unit reciprocated in opposite direction with respect to said hammer bank, said hammer bank and counter balancer units being separately driven, said printer comprising: movable type rebounding stoppers provided on opposite sides of each of said hammer bank and counter balancer units; a detector having means for measuring a turning position and a turning time of each of said units; and, a controller for said hammer bank and said counter balancer units for automatically varying a position of each of said rebounding stoppers to a proper position as a function of said turning position and turning time measured by said detector.

3. A shuttle type line printer according to claim 2, wherein said detector detects a turning position and a change of direction time of said units using a linear sensor signal, said sensor signal being outputted at preselected intervals.

* * * * *